US006230620B1

(12) United States Patent
Christmann et al.

(10) Patent No.: US 6,230,620 B1
(45) Date of Patent: May 15, 2001

(54) BEARING FOR A ROTARY PRESS CYLINDER

(75) Inventors: Dieter Christmann, Nürnberg; Hans-Dieter Drumm, Rammelsbach; Rudolf Herb, Bobenheim/Roxheim; Werner Georg Roman Straubinger, Nürnberg, all of (DE)

(73) Assignees: Koenig & Bauer Aktiengesellschaft, Wurzburg; U. E. Sebald Druck und Verlag GmbH, Nuremberg, both of (DE)

( * ) Notice: Subject to any disclaimer, the term of this patent is extended or adjusted under 35 U.S.C. 154(b) by 0 days.

(21) Appl. No.: 09/403,784

(22) PCT Filed: May 2, 1998

(86) PCT No.: PCT/DE98/01209

§ 371 Date: Feb. 9, 2000

§ 102(e) Date: Feb. 9, 2000

(87) PCT Pub. No.: WO98/50235

PCT Pub. Date: Nov. 12, 1998

(30) Foreign Application Priority Data

May 5, 1997 (DE) ..... 197 18 587

(51) Int. Cl.[7] ..... B41F 5/00

(52) U.S. Cl. ..... 101/216; 101/219; 101/477

(58) Field of Search ..... 101/216, 217, 101/218, 219, 212, 477, 375, 376, 247

(56) References Cited

U.S. PATENT DOCUMENTS

| | | | | |
|---|---|---|---|---|
| 3,610,144 | * | 10/1971 | Woessner | 101/216 |
| 4,137,843 | | 2/1979 | Ottenhue . | |
| 4,220,083 | * | 9/1980 | Fischer | 101/216 |
| 5,142,978 | | 9/1992 | Borel . | |
| 5,241,905 | * | 9/1993 | Guaraldi et al. | 101/216 |
| 5,392,709 | * | 2/1995 | Seyffert et al. | 101/216 |
| 5,394,797 | * | 3/1995 | Döbler et al. | 101/216 |
| 5,564,336 | | 10/1996 | Straubinger et al. . | |
| 5,832,829 | * | 11/1998 | Kolbe et al. | 101/216 |

FOREIGN PATENT DOCUMENTS

| | | |
|---|---|---|
| 456461 | 2/1923 | (DE) . |
| 489169 | 1/1930 | (DE) . |
| 697501 | 11/1940 | (DE) . |
| 1244807 | 7/1962 | (DE) . |
| 1261103 | 2/1968 | (DE) . |
| 2632455 A1 | 1/1978 | (DE) . |
| 2753487 | 6/1979 | (DE) . |
| 0453973 A1 | 4/1991 | (EP) . |
| 0598240 A1 | 10/1993 | (EP) . |
| 0598240 B1 | 10/1993 | (EP) . |
| 608206 | 9/1948 | (GB) . |

* cited by examiner

*Primary Examiner*—Eugene Eickholt
(74) *Attorney, Agent, or Firm*—Jones, Tullar & Cooper, PC

(57) ABSTRACT

A bearing assembly for a rotary printing press cylinder supports a journal of the cylinder using a plurality of support rollers. At least one of the cylinder journal support rollers is moveable so that the cylinder will either be supported or can be removed from the printing press.

4 Claims, 3 Drawing Sheets

BEARING FOR A ROTARY PRESS CYLINDER

FIELD OF THE INVENTION

The present invention relates to a bearing for a cylinder of a rotary printing press.

DESCRIPTION OF THE PRIOR ART

EP 0 598 240 B1 describes a rotary rotogravure printing press with eight rotogravure printing units for multicolor first and second web side printing. A forme cylinder of this rotary rotogravure printing press is supported in three support rollers of a steady rest bearing.

DE 12 44 807 A shows a forme cylinder of a rotary printing press, which can be pivoted on a lever arm GB 608 206 A discloses a bearing for cylinders, wherein the journal of the cylinder is seated on three rollers. These three rollers can be positionally displaced together.

DE 12 61 103 A describes a bearing arrangement for a printing press. In this case, the journals of the cylinders are seated on four rollers arranged in a plane, wherein respectively two rollers are arranged one behind each other and next to each other. SUMMARY OF THE INVENTION The object of the present invention is based on providing a bearing for a cylinder of a rotary printing press.

In accordance with the present invention, this object is attained by providing a bearing for a cylinder of a rotary printing press in which journals of the cylinders act together, in a first position, with at least three support rollers. When the cylinder is to be changed, at least one of the three support rollers can be brought to a second position while at least two of the support rollers stay in the first position. Alternatively, all three of the support rollers can be moved.

The advantages which can be obtained by means of the invention reside in particular, in that the change of a cylinder is very simple when using a steady rest bearing. A dependable absorption of force components in several directions is assured by "locking" by means of a support roller. It is advantageous to use the positionally changeable support roller for changing a position for example, lifting, or lowering of the cylinder.

BRIEF DESCRIPTION OF THE DRAWINGS

Preferred embodiments of the invention is represented in the drawings and will be described in greater detail in what follows.

Shown are in.

DESCRIPTION OF THE PREFERRED EMBODIMENTS

Figure 1:
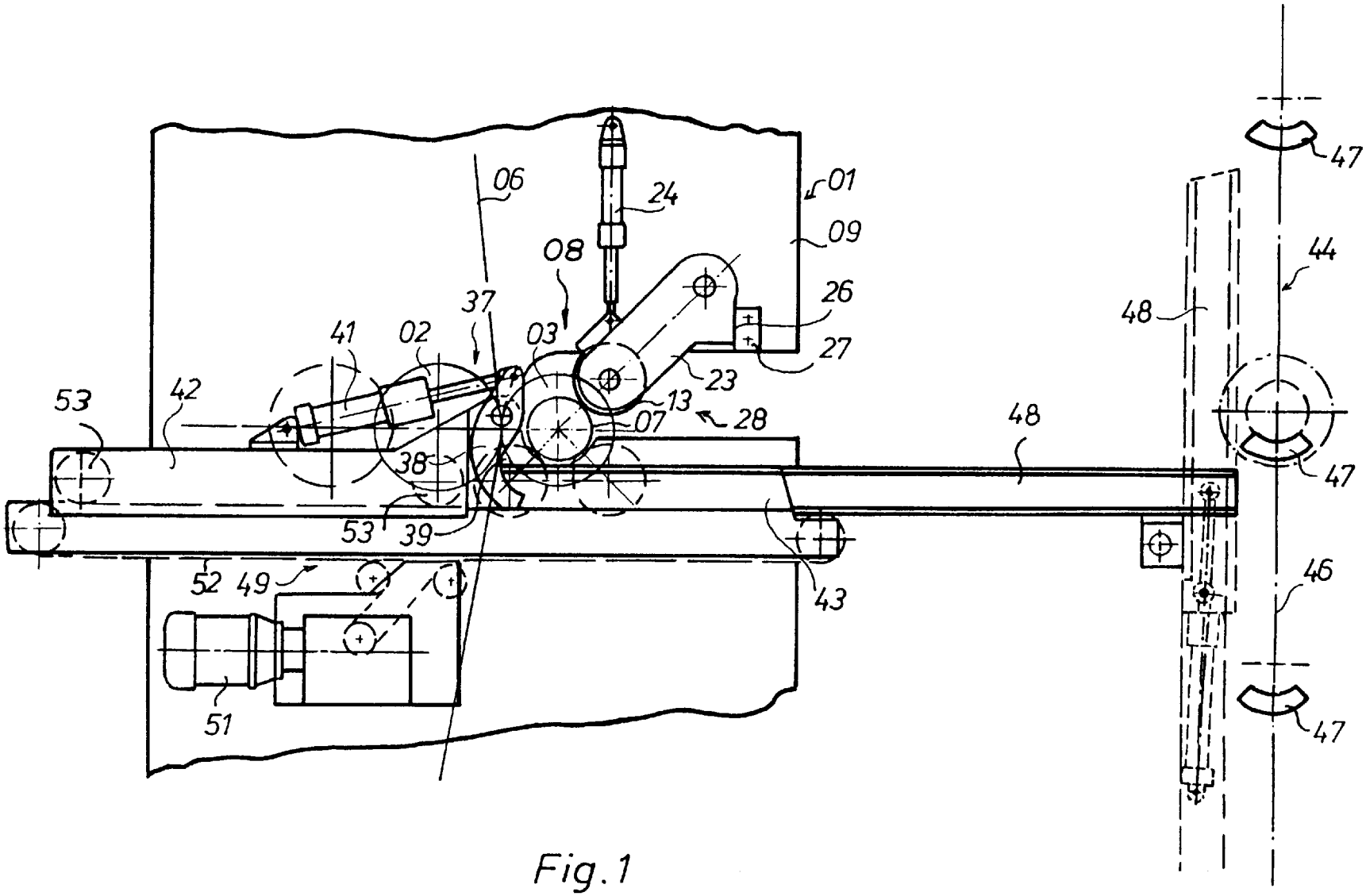
FIG. 1, a schematic lateral view of a steady rest bearing of a first preferred embodiment of the present invention, FIG. 2, an enlarged portion of the steady rest bearing in FIG. 1, and in FIG. 3, a schematic lateral view of a steady rest bearing of a second preferred embodiment of the present invention.
Figure 2:
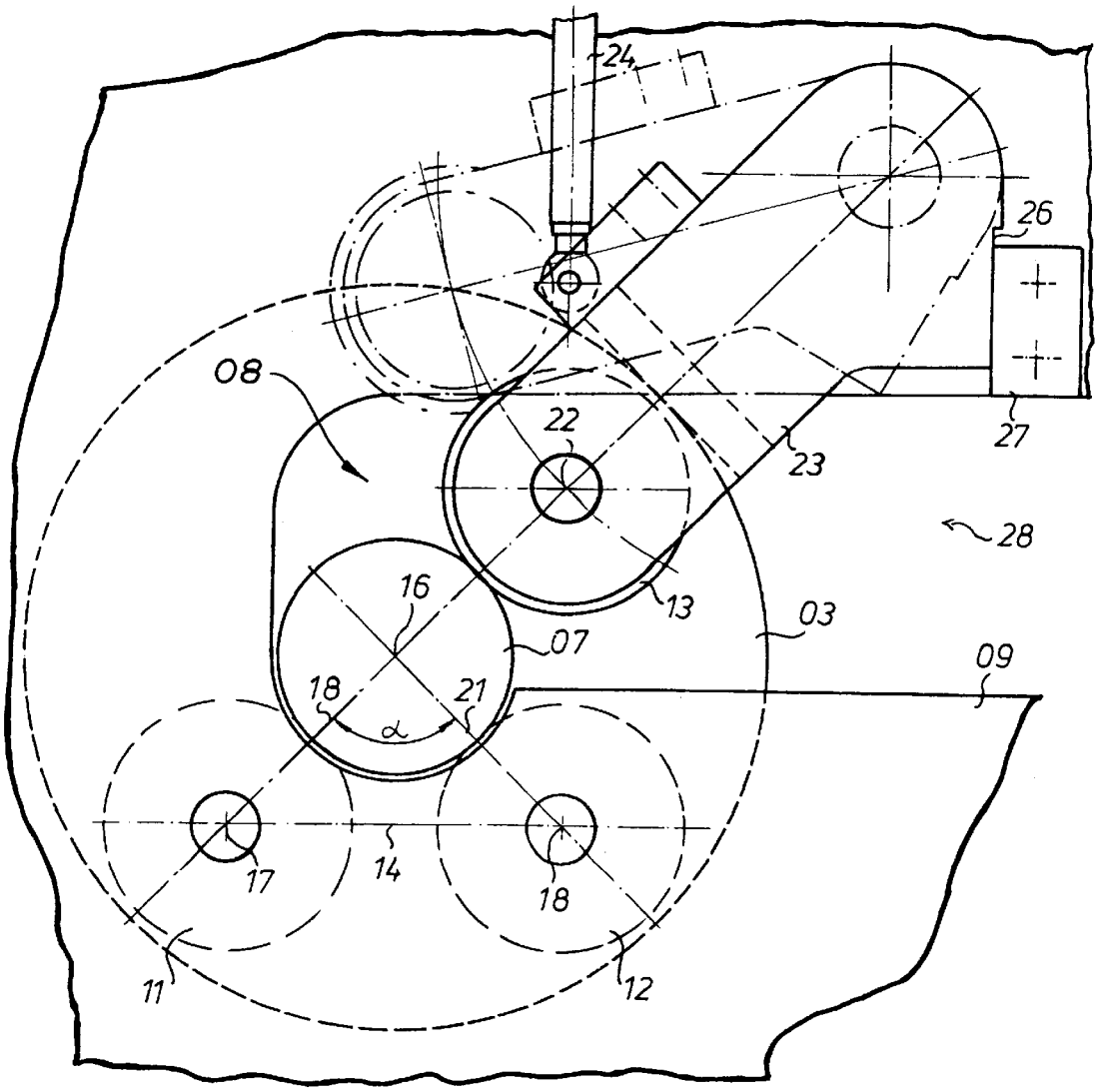

A printing unit 01 of a rotary rotogravure printing press is depicted schematically in FIG. 1, and in more detail in FIG. 2 and essentially consists of an impression cylinder 02, a forme cylinder 03 and an ink application device. A material to be imprinted, for example a web 06, is printed by a rotogravure process between the impression cylinder 02 and the forme cylinder 03. The forme cylinder 03 is provided with journals 07 on both sides.

The journals 07 of the forme cylinder 03 are each seated by means of a steady rest bearing, generally at 08, in relation to a lateral frame 09 of the rotary rotogravure printing press. For this purpose, at least two rotatably seated, fixed support rollers 11, 12 are arranged at or in the lateral frame 09. A third, moveable support roller 13 is provided in the depicted first preferred embodiment shown in FIGS. 1 and 2.

The first two fixed support rollers 11, 12 support the journal 07 of the forme cylinder 03 and act against the weight of the forme cylinder 03. For example, the two, fixed support rollers 11, 12 are approximately arranged on a horizontal line 14. A first straight line 18, defined by an axis of rotation 16 of the forme cylinder 03 and an axis of rotation 17 of the first support roller 11 constitutes an opening angle $\alpha$ with respect to a second straight line 21, defined by an axis of rotation 16 of the forme cylinder 03 and an axis of rotation 19 of the second support roller 13. This opening angle $\alpha$ is between 30° to 150°, and is preferably between 75° to 105°.

For fine adjustment with respect to the lateral frame 09, the support rollers 11, 12, 13 can each be adjusted by means of eccentric bolts.

An axis of rotation 22 of the third, moveable support roller 13 is arranged approximately opposite to the axis of rotation of first support roller 11 with respect to the journal 07 of the forme cylinder 03 and on the straight line 18 defined by the axes of rotation 17, 16 of the first support roller 11 and of the forme cylinder 03. This moveable support roller 13 is rotatably seated on a first end of a pivotable lever 23. This pivotable lever 23 is rotatable in respect to the lateral frame 09, so that the support roller 13 is seated so it is pivotable or moveable in respect to the lateral frame 09. Pivoting of this support roller 13 is performed by means of an actuating drive, for example by a work cylinder 24. This work cylinder 24 is hingedly connected with the lateral frame 09, as well as with the lever 23 supporting the moveable support roller 13. The pivotable lever 23 has a contact movable surface 26 which, in the operational position of the support roller 13, cooperates with a detent 27 fixed in place on the frame 09, all as seen most clearly in FIG. 2.

The lateral frame 09 is provided with a frame opening 28, for example a horizontally extending slit.

For removing the forme cylinder 03, the third, moveable support roller 13 is positionally changeably arranged, i.e. the third, moveable support roller 13 can be brought from a first operating position into a second, change position.

In the operating position, the support roller 13 acts as a counter-brace for the forces generated during printing.

Figure 3:
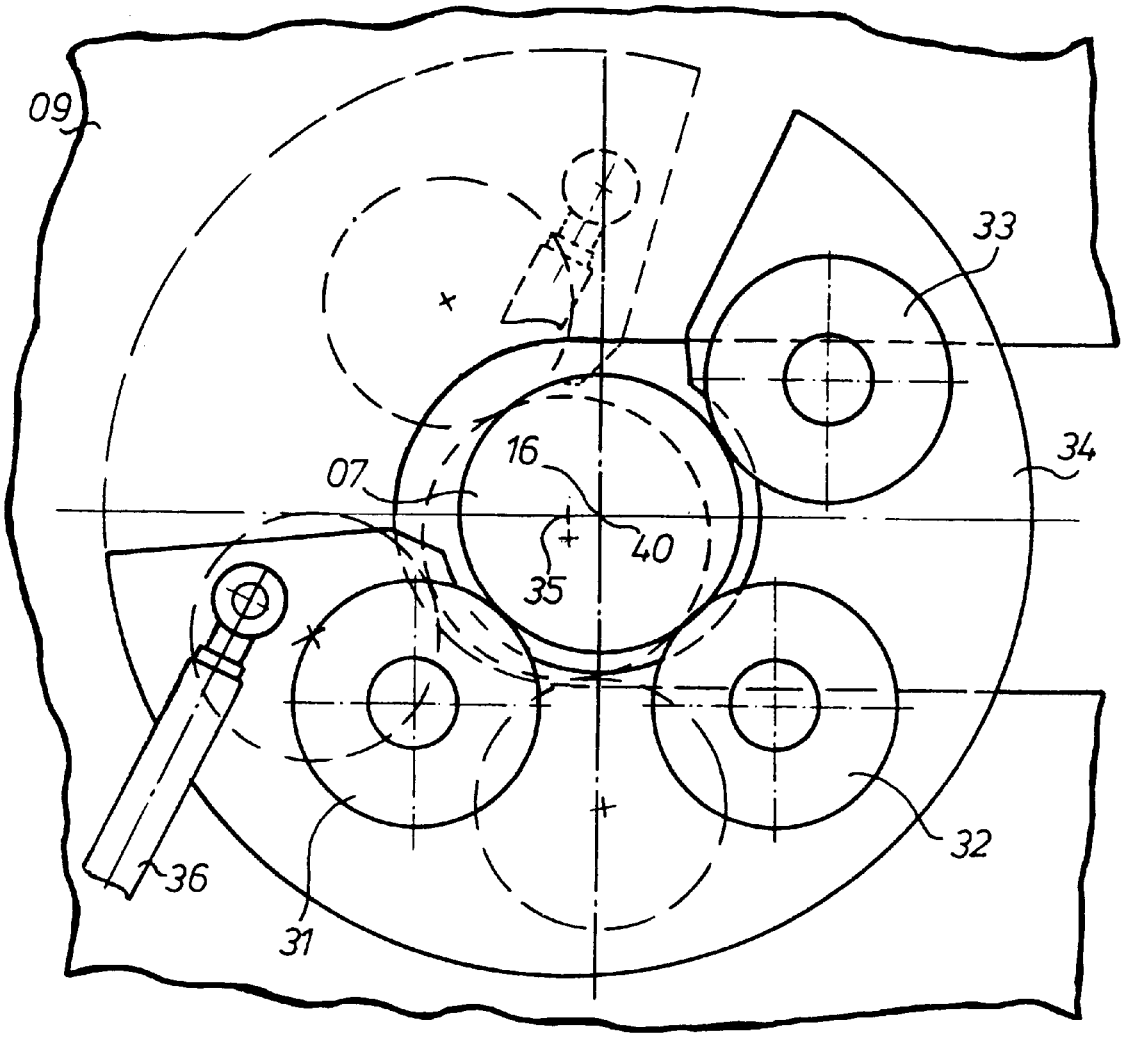

In a second preferred embodiment of the present invention, as seen in FIG. 3, three journal support rollers 31, 32, 33, shown in FIG. 3, for example, are arranged on a common roller support 34. This support 34 is embodied as a bearing bushing 34 having an opening standing in the radial direction of the busing 34. This opening is larger than a diameter of the journal 07 of the forme cylinder 03 and extends by less than 180° in the circumferential direction of the bushing 34. A bore, which also has an opening in the radial direction for the removal of the forme cylinder 03, is arranged in the lateral frame 09 for receiving this bearing bushing or roller support 34. This roller support 34 for the support roller 31, 32, 33 is pivotably arranged in respect to the lateral frame 09 in a plane extending perpendicularly to the axis of rotation 16 of the forme cylinder 03. A work cylinder 36 is provided for pivoting this bearing bushing or roller support 34.

A center 40 of a reference circle defined by the axis of rotation of the support rollers 31, 32, 33 is offset by an eccentricity "e" in relation to a pivot axis 35 of the roller support 34.

A change in the position of the forme cylinder 03 is caused by pivoting the roller support 34. In the present configuration depicted in FIG. 3 the forme cylinder 03 is lowered by rotation of the roller support 34 between the position shown in full lines and the position shown in dashed lines.

If no positional change of the forme cylinder 03 is required, no eccentricity will be provided.

With the bearing in accordance with the present invention for the support of a cylinder of a rotary printing press, at least one support roller is arranged so it can be brought from an operating position into a change position. At least one support roller of the bearing of the cylinder can be positionally changed.

Even with a steady rest bearing with only two support rollers, at least one support roller can be positionally changed.

In the first preferred embodiment, as may be seen by again referring to FIG. 1, a lifting device 37 for lifting, or respectively lowering, the forme cylinder 03 during a cylinder change is assigned to each cylinder journal 07. This cylinder lifting device 37 consists essentially of a pivotable, two-armed cylinder journal lifting lever 38. A first end of this lifting lever 38 is provided with a receptacle 39, for example a shell-shaped receptacle 39, for the journal 07 of the forme cylinder 03. An actuating drive 41, for example a work cylinder 41, acts on the second end of the cylinder journal lifting lever 38.

This cylinder lifting device 37 is positionally changeable. In the first preferred embodiment, the cylinder lifting device 37 is arranged on a transport device 42, for example a movable carriage 42. This moveable carriage 42 has rollers, which run on carriage roller rails 43 fastened on the lateral frame 09. These rails 43 can be extended as far as to a transport vehicle or, as in the first preferred embodiment, to an elevator 44. This elevator 44 consists, for example, of circulating chains 46, on which support elements 47, embodied as half-shells 47 for receiving the journals 07 of the forme cylinder 03, have been attached. Foldable rail elements 48 are arranged between these support elements 47 of the elevator 44 and the rails 43 of the respective forme cylinder 03.

A linear drive 49 is provided for driving the carriage 42. In the first preferred embodiment, this linear drive 49 is designed as a rotating chain 52, driven by a drive motor 51. Catchers 53 designed as chain wheels and fastened on the displaceable carriage 42 mesh with this chain 52.

For changing the forme cylinder 03, first the third, moveable support roller 13 of the steady rest bearing assembly generally at 08 is pivoted away. The carriage 42 moves into a lift-out position, so that the two-armed lever 38 can extend below the journal 07 of the forme cylinder 03. The work cylinder 41 of the two-armed lever 38 is retracted, and the shell-shaped receptacle 39 of the lever 38 lifts the forme cylinder 03. The drive motor 51 of the chain 52 is triggered and moves the carriage 42 with the lifted forme cylinder 03 out of the lateral frame 09 in the direction toward the elevator 44. The carriage 42 reaches the elevator 44 via the lowered rail elements 48. The journals 07 of the forme cylinder 03 are positioned above the support elements 47 of the elevator 44 and the drive motor 51 for the chains 52 is switched off. For depositing the forme cylinder 03, either the work cylinder 41 of the receptacle 39 of the carriage is extended, or the support element 47 of the elevator 44 is moved upward. It will be understood that two of the two-armed levers 38 are utilized, one for each of the journals 07 which are located at the two ends of the forme cylinders 03. Similarly, two support elements 47 are provided on the elevator 44, again so that both journals 07 will be supported.

For delivering a fresh forme cylinder 03, the elevator 44 is displaced and positioned in respect to the receptacles 39 of the carriage 42. Subsequently, a fresh forme cylinder 03 is received from the elevator 44 and is transported to the steady rest bearing assembly 08. In the course of this, the above described steps are performed in the reverse order.

A transport device, which is not specifically represented, is assigned to the second preferred embodiment of the present invention. This transport device does not have a lifting device, but only a receptacle for the journals 07 of the forme cylinder 03. Here, lifting and lowering of the forme cylinder 03 is performed by means of the steady rest bearing 08, 31, 32, 33 itself, or respectively by means of the elevator 44.

Thus, a linearly displaceable transport device 42, which can be positioned by means of an actuating drive 51, is assigned to each forme cylinder 03.

This transport device 42 can be provided with a lifting device 37. It is also possible to design the steady rest bearing 08 as a lifting device. This transport device 42 can also be used for changing the impression cylinder 02 assigned to the respective forme cylinder 03. For this purpose, the transport device 42 can be displaced sufficiently so that the receptacle 39 of the transport device 42 comes underneath the impression cylinder 02. While preferred embodiments of a bearing for a rotary press cylinder in accordance with the present invention have been set forth fully and completely hereinabove, it will be apparent to one of skill in the art that various changes in, for example, the overall size of the bearings, the specific type of cylinder, and the like could be made without departing from the true spirit and scope of the present invention which is accordingly to be limited only by the following claims. In this case the rails 43, 48 of the transport device 42 are arranged on the inside of the lateral frame 09.

This cylinder exchange device and the steady rest bearing can also be used for other exchangeable cylinders of a rotary printing press.

What is claimed is:

1. A bearing assembly for a cylinder of a rotary printing comprising:

a lateral frame including a frame opening slit;

at least three support rollers, said at least three support rollers cooperating to support a journal of a cylinder in said lateral frame;

means supporting two of said at least three support rollers in fixed positions on said lateral frame; and means for supporting a third one of said at least three support rollers for movement with respect to said lateral frame between a first, journal support position and a second, cylinder change position in which a cylinder is removable from said lateral frame along said frame opening slit.

2. The bearing assembly of claim 1 wherein said means for supporting said third one of said at least three support rollers includes a pivotable lever, said third one of said support rollers being positioned on said pivotable lever.

3. The bearing assembly of claim 1 wherein said means for supporting said third one of said at least three support rollers includes an eccentric support for said third one of said support rollers.

4. A bearing assembly for a cylinder of a rotary printing press comprising:

at least three support rollers, said at least three support rollers cooperating to support a journal of a cylinder;

a pivotable support, said pivotable support supporting said at least three support rollers; and means for moving said pivotable support between a first, cylinder operating position and a second, cylinder changing position, the one of said at least three support rollers which is located in a highest position on said pivotable support in said cylinder operating position being located in a lowest position in said cylinder changing position.

* * * * *